US009561425B2

(12) United States Patent
Baird

(10) Patent No.: US 9,561,425 B2
(45) Date of Patent: Feb. 7, 2017

(54) COMPRESSIVE BOARD

(71) Applicant: David Baird, Bristow, VA (US)

(72) Inventor: David Baird, Bristow, VA (US)

( * ) Notice: Subject to any disclaimer, the term of this patent is extended or adjusted under 35 U.S.C. 154(b) by 0 days.

(21) Appl. No.: 14/482,461

(22) Filed: Sep. 10, 2014

(65) Prior Publication Data

US 2016/0067589 A1 Mar. 10, 2016

(51) Int. Cl.
*A63C 17/26* (2006.01)
*A63C 17/00* (2006.01)
*A63C 17/01* (2006.01)

(52) U.S. Cl.
CPC ..... *A63C 17/26* (2013.01); *A63C 17/0046* (2013.01); *A63C 17/012* (2013.01); *A63C 17/015* (2013.01); *A63C 2203/42* (2013.01)

(58) Field of Classification Search
CPC ..... A63C 17/26; A63C 17/01; A63C 17/0046; A63C 2203/20; A63C 2203/42; A63C 2203/00; A63C 2203/10
See application file for complete search history.

(56) References Cited

U.S. PATENT DOCUMENTS 4,055,234 A * 10/1977 Burton ..... A63C 17/01 188/19
4,099,734 A * 7/1978 Lowery ..... A63C 17/01 188/5
4,744,576 A * 5/1988 Scollan, Jr. ..... A63C 17/004 280/11.211
5,002,294 A 3/1991 Franz
5,090,716 A * 2/1992 Borden ..... A63C 17/004 280/87.042
5,221,111 A 6/1993 Younger
6,145,857 A 11/2000 Berstein
6,199,881 B1 3/2001 Wood et al.
6,224,076 B1 5/2001 Kent
6,832,979 B1 12/2004 Yarbrough
7,070,192 B1 7/2006 Steiner
7,866,672 B2 1/2011 Brunner
7,980,573 B1 7/2011 Naman
(Continued)

FOREIGN PATENT DOCUMENTS

CN 201304230 Y 9/2009
CN 203090414 U 7/2013
FR 2439604 A1 * 5/1980 ..... A63C 17/01

OTHER PUBLICATIONS

International Search Report dated Dec. 18, 2015 issued in corresponding International Application No. PCT/US15/49309.

*Primary Examiner* — J. Allen Shriver, II
*Assistant Examiner* — Steve Clemmons
(74) *Attorney, Agent, or Firm* — Nath, Goldberg & Meyer; Joshua B. Goldberg

(57) ABSTRACT

A compression board apparatus of a generally planar surface has an insert that compresses to a position that is flat or flush with a top surface of the board, when a load is applied to the top surface of the board. When the load is removed, the insert releases, thereby expanding to a released position. The insert is arranged to both extend above the top surface of the board and extend below a bottom surface of the board. The insert may be secured by at least locking mechanism and enables a user who applies a load to the top surface of the board to maintain contact with the board's surface, even in an airborne position and when the board is in a non-planar position.

8 Claims, 11 Drawing Sheets

(56) References Cited

U.S. PATENT DOCUMENTS

| | | | | |
|---|---|---|---|---|
| 8,371,594 | B2 * | 2/2013 | Palmer | A63C 17/01 280/11.215 |
| 8,556,289 | B2 | 10/2013 | Luthardt | |
| 8,608,182 | B2 | 12/2013 | Mete | |
| 8,801,003 | B1 * | 8/2014 | Cassidy | A63C 17/0046 280/11.223 |
| 2002/0046981 | A1 | 4/2002 | Amish | |
| 2003/0075890 | A1 | 4/2003 | Jacobs | |
| 2003/0116941 | A1 * | 6/2003 | Mash | A63C 5/075 280/607 |
| 2005/0206109 | A1 | 9/2005 | Mash | |
| 2007/0170677 | A1 | 7/2007 | Wake | |
| 2010/0304941 | A1 * | 12/2010 | Ota | A63C 5/03 482/146 |
| 2011/0291375 | A1 | 12/2011 | Lawson | |
| 2013/0310235 | A1 | 11/2013 | Carr | |

* cited by examiner

COMPRESSIVE BOARD

CROSS REFERENCES TO RELATED APPLICATIONS

Not Applicable

STATEMENT REGARDING FEDERALLY SPONSORED RESEARCH

Not Applicable

BACKGROUND

A. Technical Field

The present subject matter relates to the field of compressive boards and board sports. More specifically, the present subject matter is directed to a compressive board assembly that includes a compressive insert, so as to remain in contact with a load or to permit a user applying a load to easily remain in contact with the board at any time, even when the user performs airborne maneuvers or the compressive board is in a non-planar position.

B. Discussion of the Prior Art

Historically, skateboards, scooters, surfboards, and other board assemblies provide a platform for users to perform airborne maneuvers or perform moves where the board is placed in a non-planar position. In these board sports and the like, the user is often physically challenged to perform complex maneuvers and move the board so that the user's feet remain in contact with a top surface of the board or land on the top surface of the board.

Additionally, users often desire to perform moves where the user and the board reach the highest height possible. Furthermore, a person having ordinary skill in the art is aware that boards frequently become damaged and break due to a myriad of factors, regardless of the user's level of skill, including but not limited to user size, weight, landing position, materials used to construct the board, and the brand name of the board. In fact, it is common for professional board users, specifically professional skaters, to quickly go through boards due to damage from normal use. No prior art discloses a board apparatus that is configured to overcome these disadvantages of existing boards.

Bernstein, U.S. Pat. No. 6,145,857, discloses a skateboard assembly with a platform 32, kicktail 34, and an accessory panel 12 arranged below the platform and kicktail. However, Bernstein fails to disclose an insert that is arranged within the platform and that fully compresses.

Yarbrough, U.S. Pat. No. 6,832,979, discloses a mobile spring board construction with a board 12, spring members 14, 16, and foot straps 22, 24. However, Yarbrough fails to disclose an insert that is arranged within the board and a board configuration that permits a load, such as a user's feet, to be placed at any position the user desires along a board top surface.

SUMMARY

In an aspect of the present subject matter, a compressive board apparatus includes a generally planar surface with an upturned front end and an upturned rear end. The compressive board has at least one front wheel that is fixed on a first shaft and arranged near the front end, and at least one rear wheel that is fixed on a second shaft and arranged near the rear end.

Furthermore, the compressive board apparatus includes an insert arranged within a central portion of the compressive board. The insert of the compressive board is arranged to both extend above a top surface of the board and extend below a bottom surface of the compressive board. A plurality of compression members are arranged within the insert so that the insert compresses along its entire length and width to extend below the bottom surface of the board when a load is applied.

The foregoing and other features and advantages of the present subject matter are more readily apparent from the following detailed description. The detailed description proceeds with references to the accompanying drawings.

BRIEF DESCRIPTION OF THE DRAWINGS

The accompanying drawings, which are included to provide a further understanding of the subject matter and are incorporated in and constitute a part of this specification, illustrate non-limiting embodiments of the subject matter and, together with the description, serve to explain the principles of the subject matter.

In the drawings.

DETAILED DESCRIPTION OF THE EMBODIMENT

Figure 1:
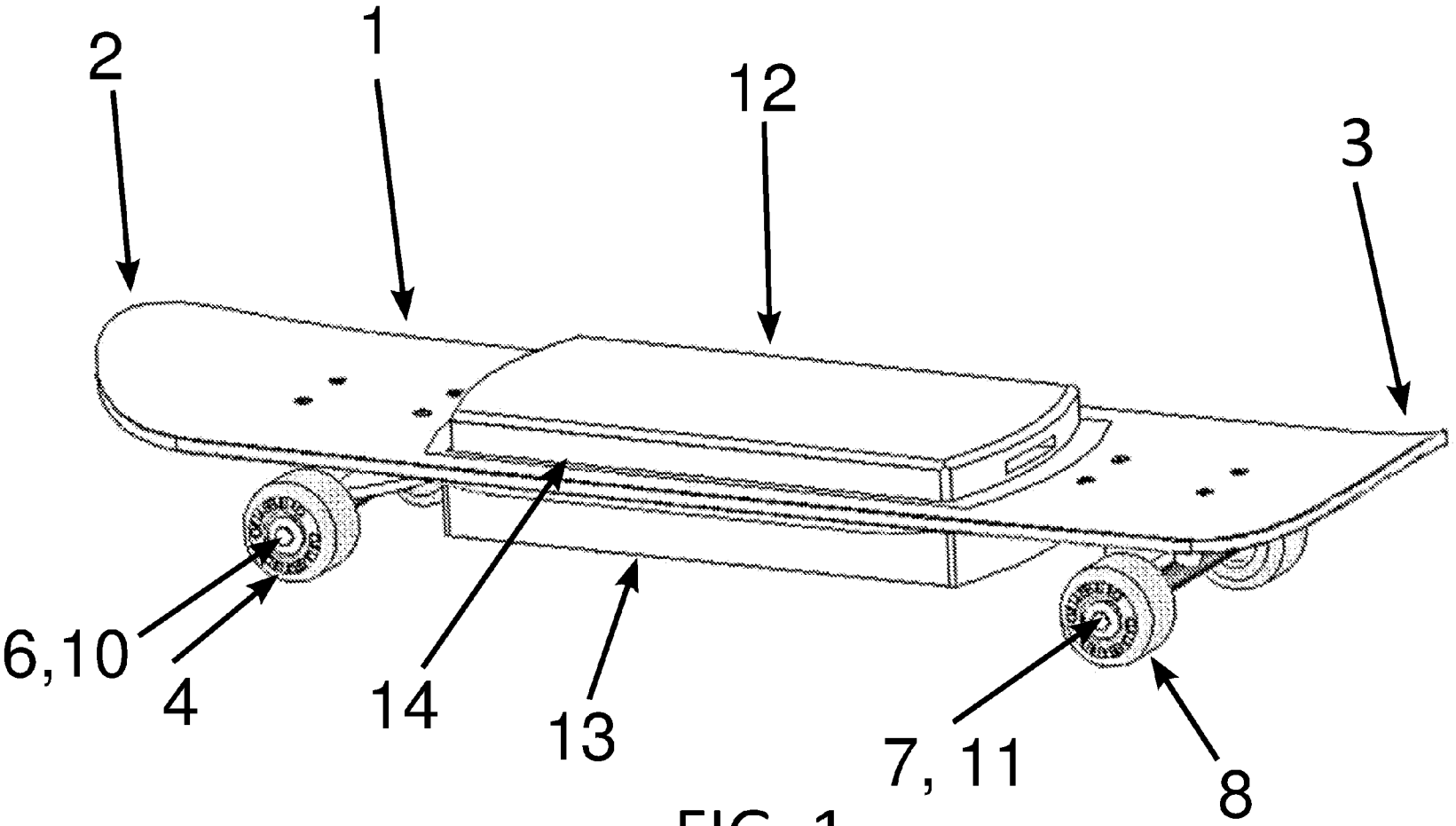
FIG. 1 is a perspective view of a compressive board from one side of the board.
Figure 2:
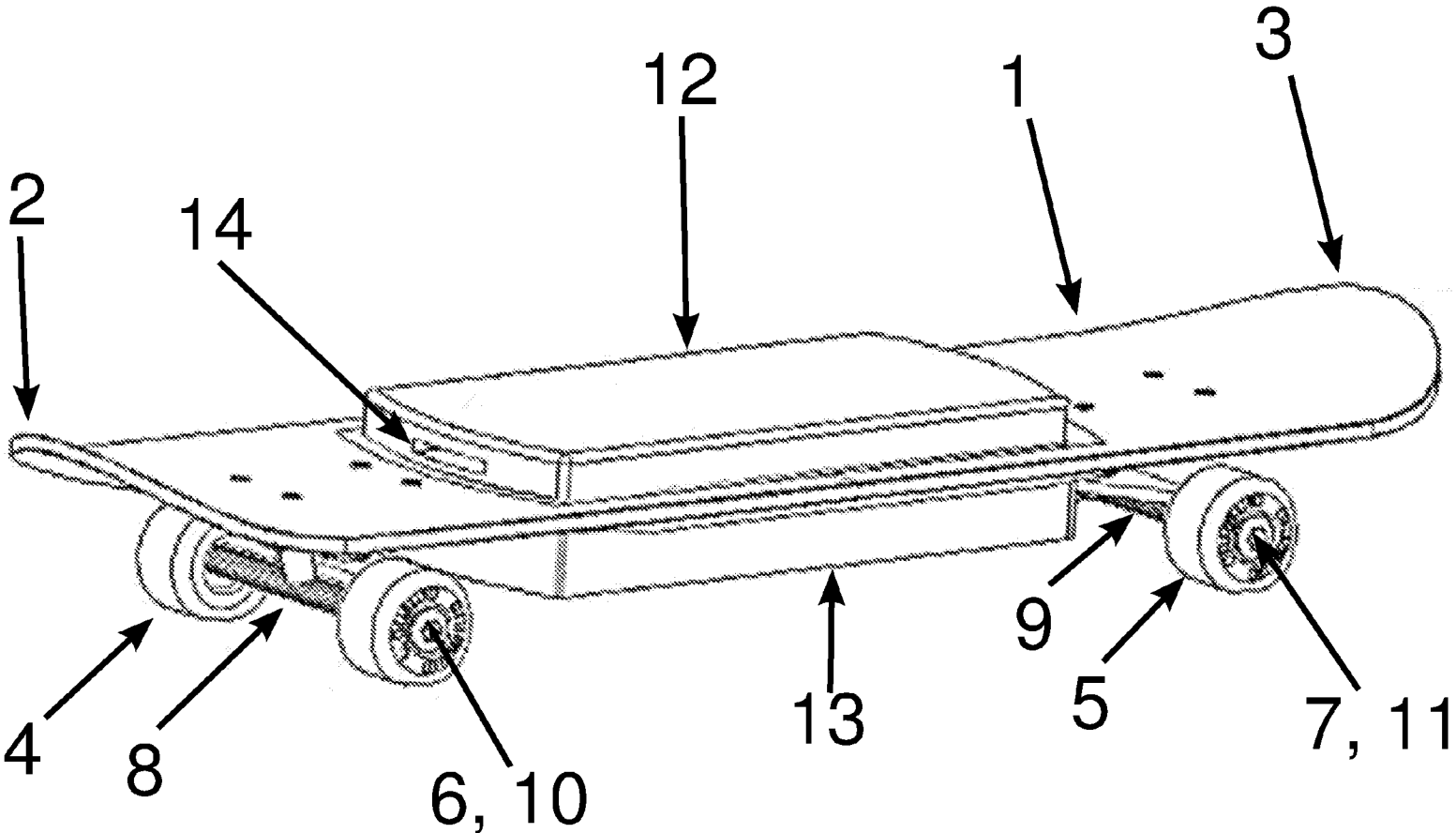
FIG. 2 is another perspective view of the compressive board from the opposite side of the board.
Figure 3:
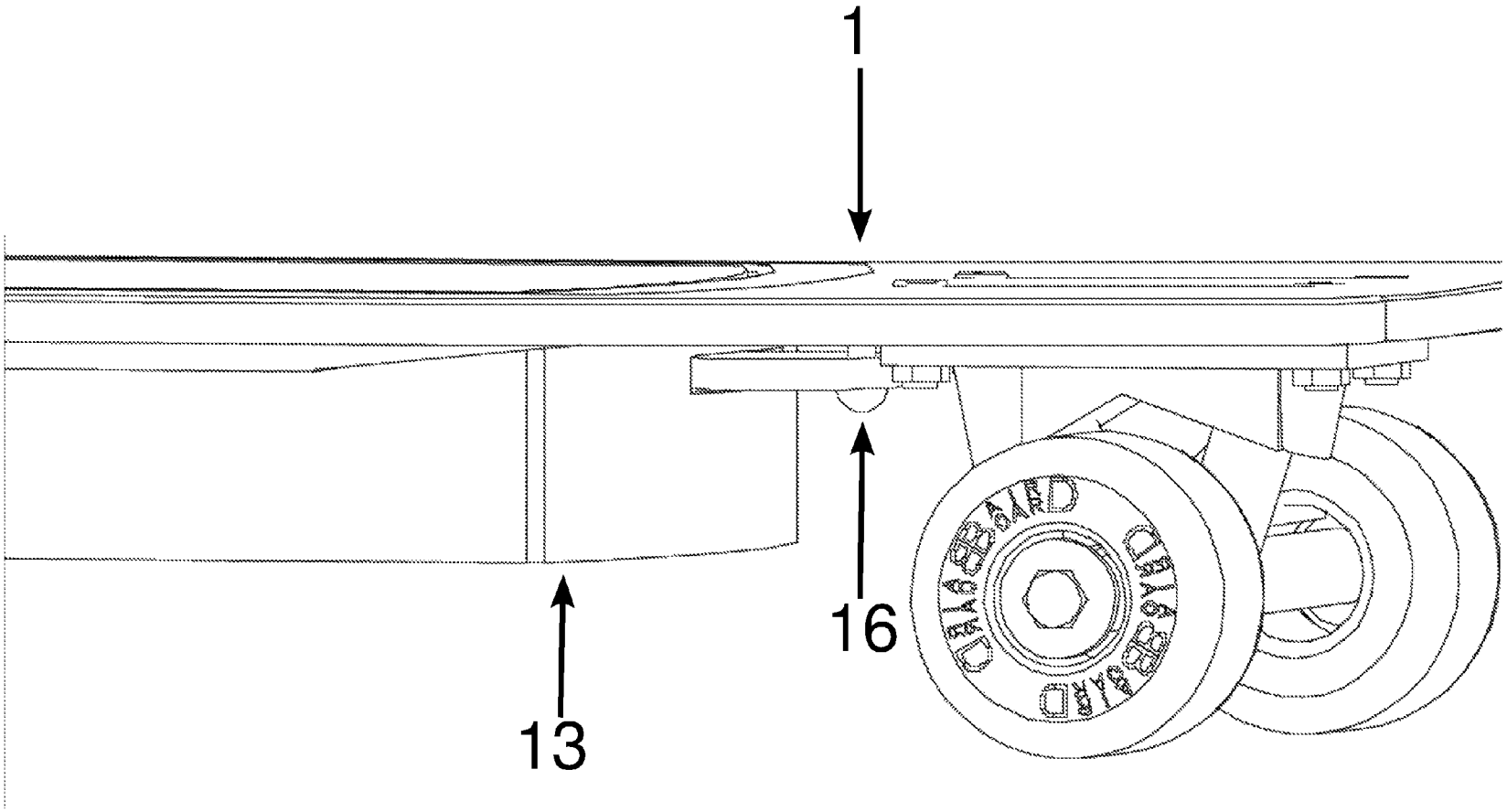
FIG. 3 is a perspective view of the compressive board assembly in a compressed position.

FIGS. 1 and 2 show perspective views of the compressive board apparatus, from a right and a left side of the board, respectively, prior to a load being applied to the board's top surface. The board 1 includes a concave front end or nose 2 and a concave rear end or tail 3. The board may consist of a plurality of materials, including but not limited to one or more of wood, fiberglass, high strength plastic, etc.

Figure 4:
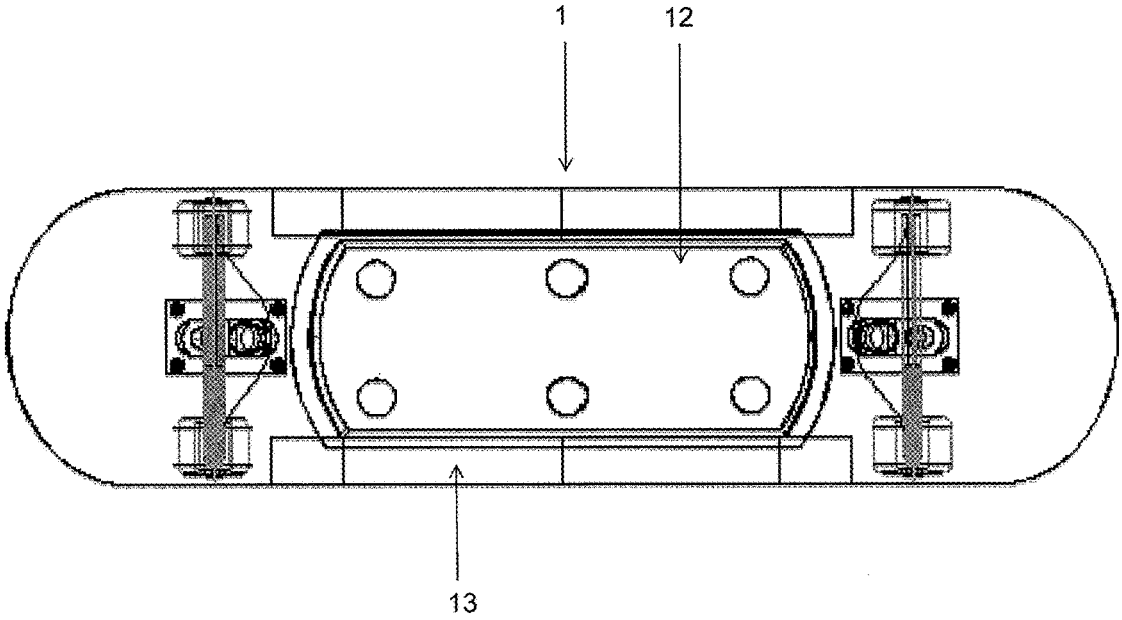
FIG. 4 is a bottom view of the compressive board assembly of FIGS. 1 and 2.
Figure 5:
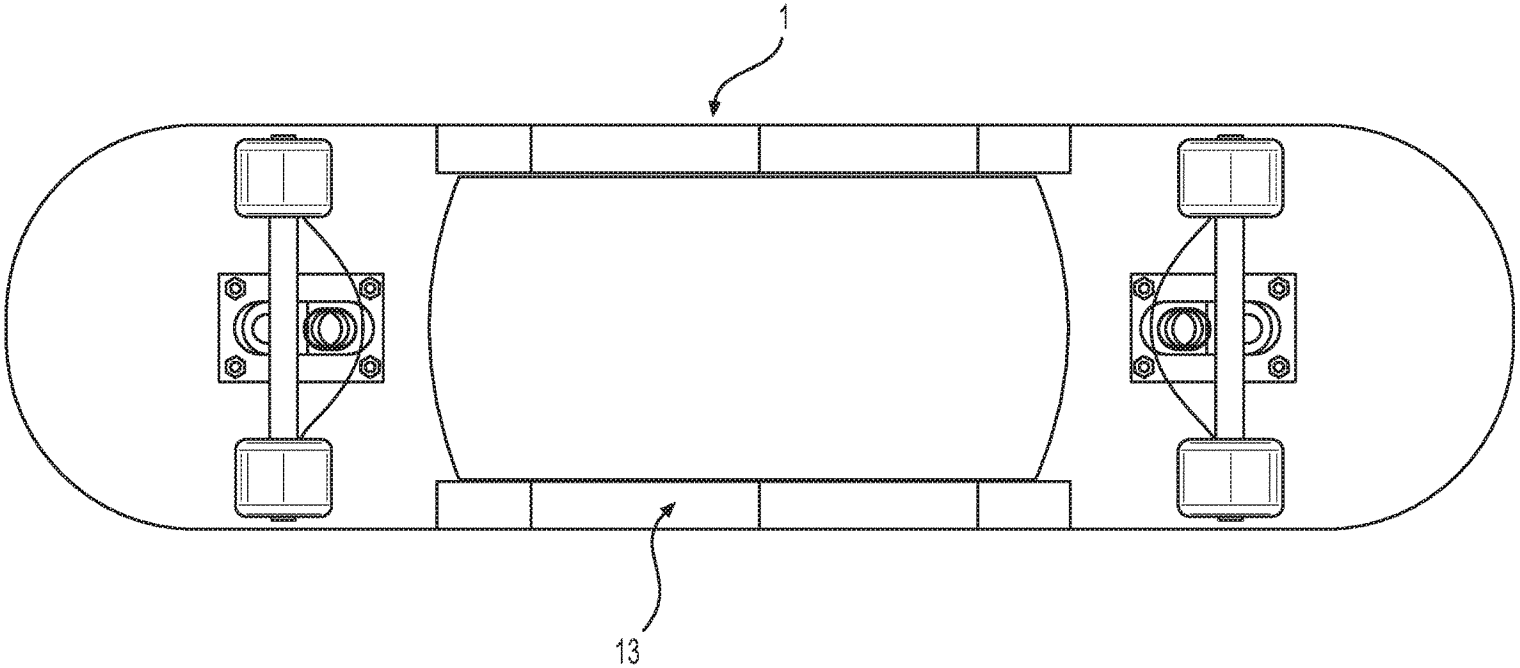
FIG. 5 is a bottom view of the compressive board assembly of FIGS. 1 and 2, shown with a compressive insert removed.
Figure 6:
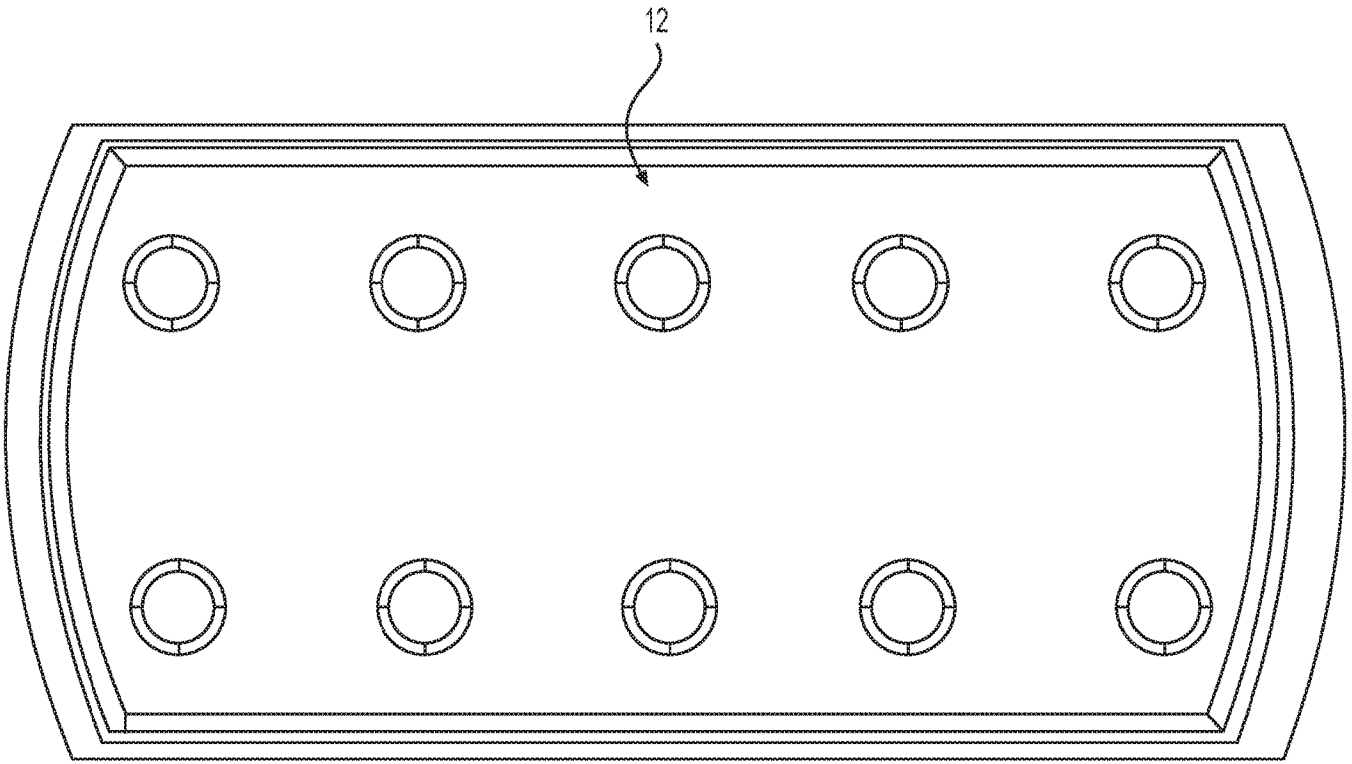
FIG. 6 is a bottom view of a compressive insert of the compressive board assembly.

In a non-limiting embodiment of the compressive board apparatus, as shown in FIGS. 4 and 5, at least one front wheel 4 is fixed on a first axle 6, and at least one rear wheel 5 is fixed on a second axle 7. Each axle is a rod that is arranged through a hanger 8, 9. Holding each wheel in place is an axle nut 10, 11 that is threaded onto the axle 6, 7. In another non-limiting embodiment of the compressive board apparatus, at least two front wheels are fixed on a first axle, and at least two rear wheels are fixed on a second axle.

Referring to FIGS. 1-3 and 12, the board includes a plurality of mounting holes for attachment to the front and rear wheel assemblies or board trucks, as known to a person having ordinary skill in the art. Additionally, the top surface of the board and insert 12 may be covered by grip tape or a material to improve user's traction with the surface of the board. Regardless of the material of the board's surface, the insert is arranged so that a user's feet may grip the insert by exerting a compressive motion along sides of the insert, thereby preventing the user from slipping off of the board.

Figure 7:
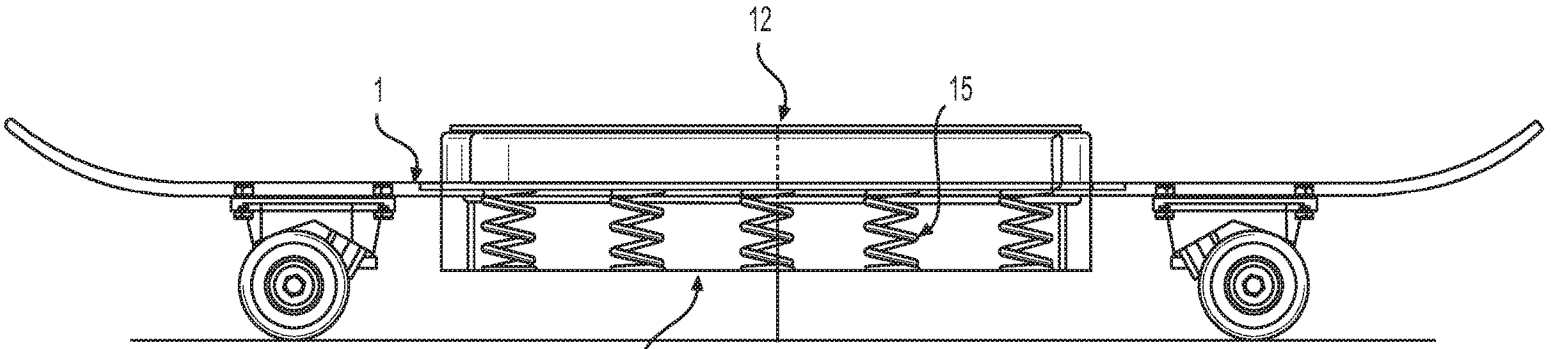
FIG. 7 is a side view of the compressive board assembly of FIGS. 1 and 2, shown with the compressive insert in an extended or released position.
Figure 8:
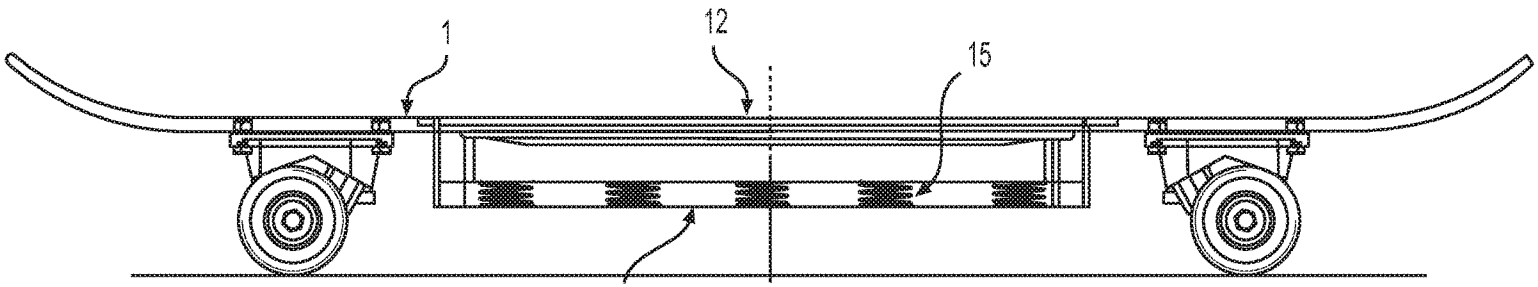
FIG. 8 is a side view of the compressive board assembly of FIGS. 1 and 2, shown with the compressive insert in a compressed position.
Figure 9:
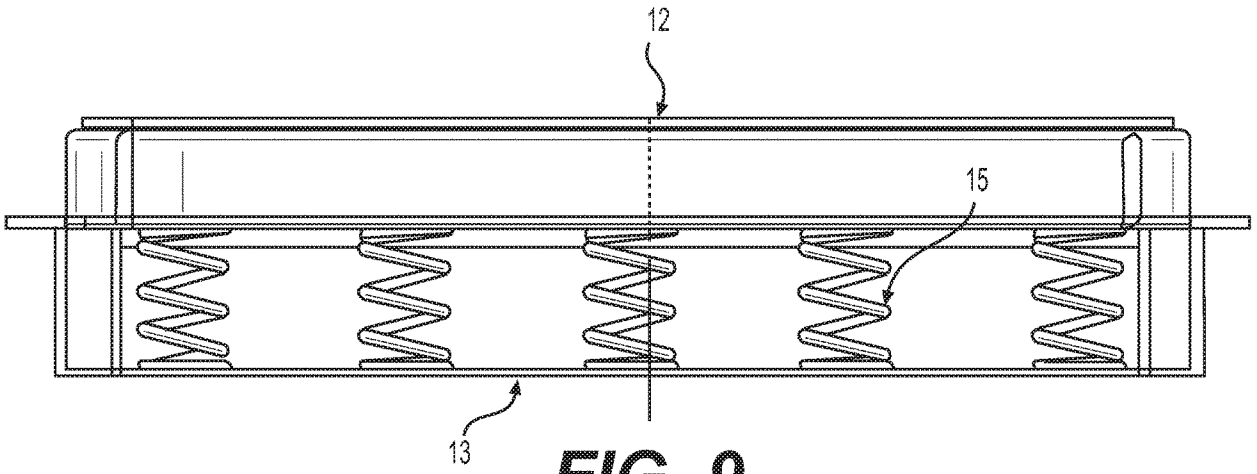
FIG. 9 is a side view of the compressive insert of FIG. 5, shown in the extended or released position.
Figure 10:
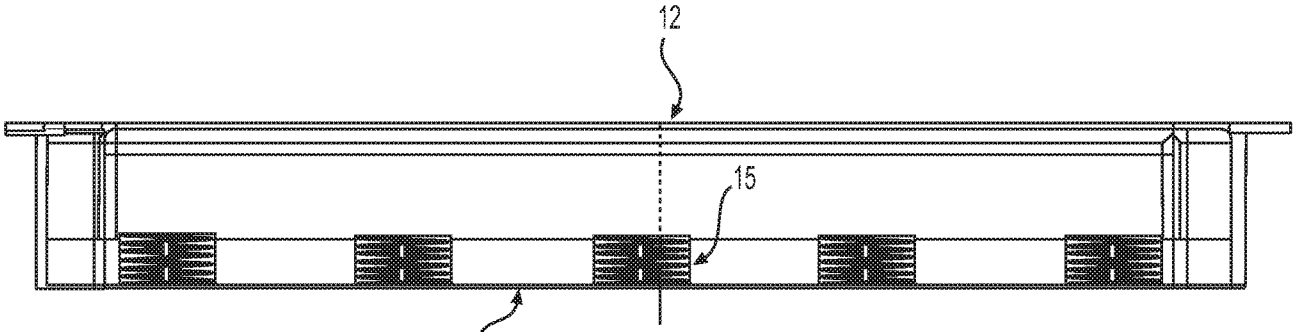
FIG. 10 is a side view of the compressive insert of FIG. 5, shown in the compressed position.
Figure 11:
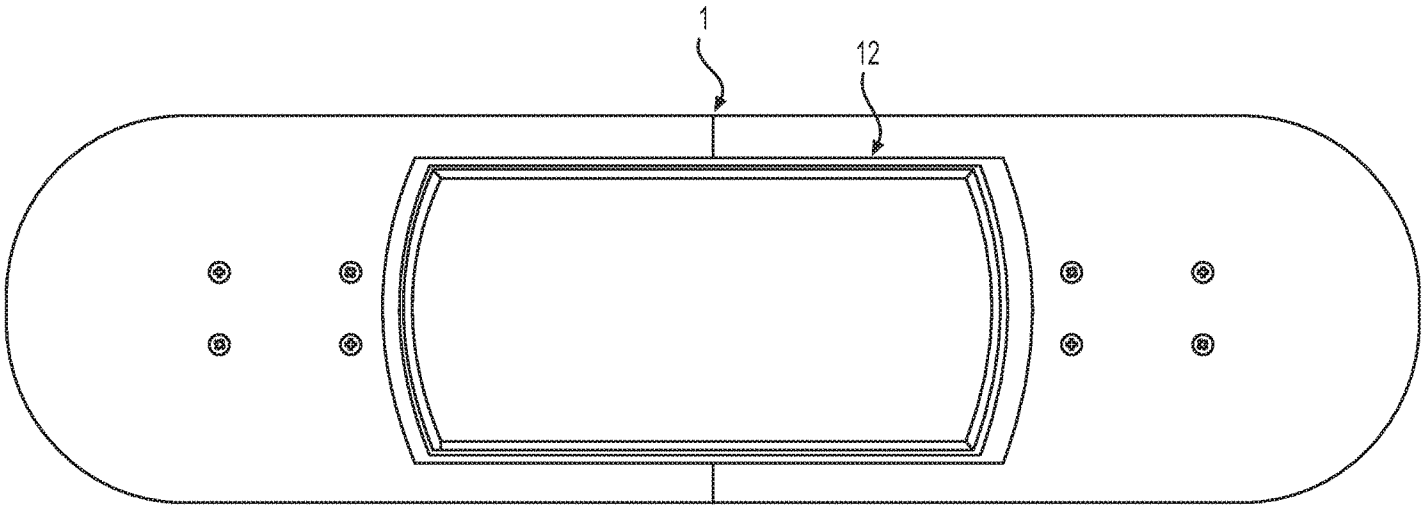
FIG. 11 is a perspective view of a non-limiting exemplary embodiment of one side of the compressive board including an attachment mechanism.
Figure 12:
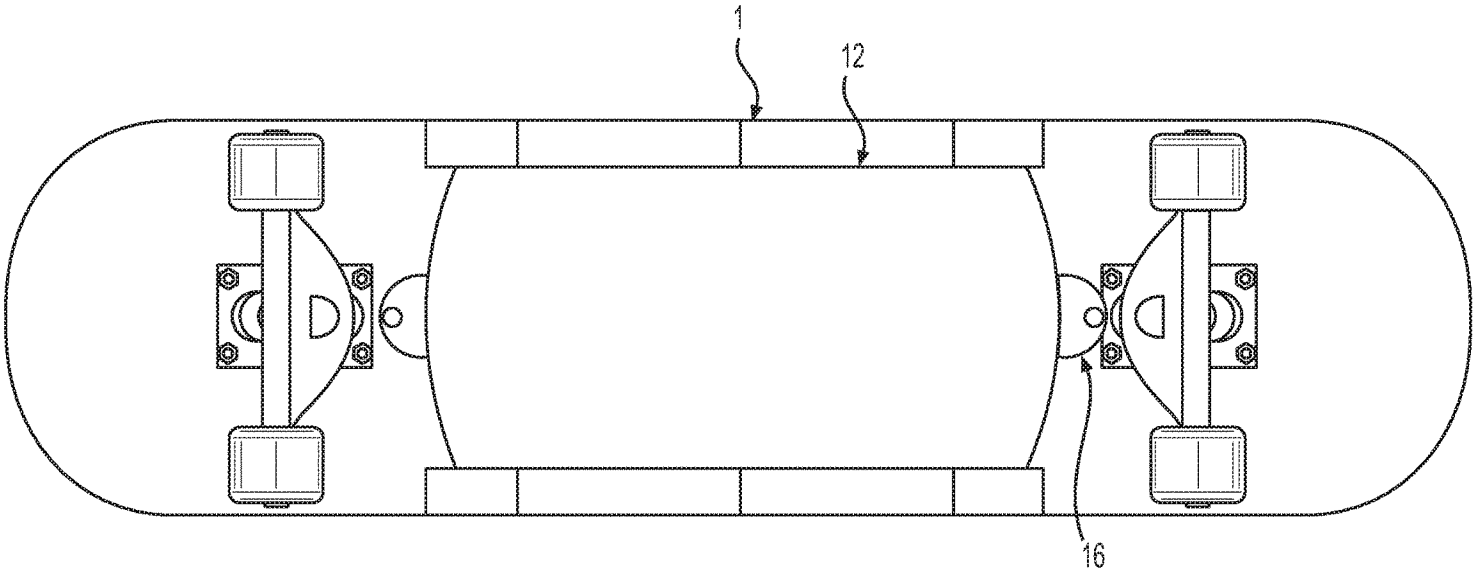
FIG. 12 is a bottom view of the compressive board assembly of FIG. 11.
Figure 13:
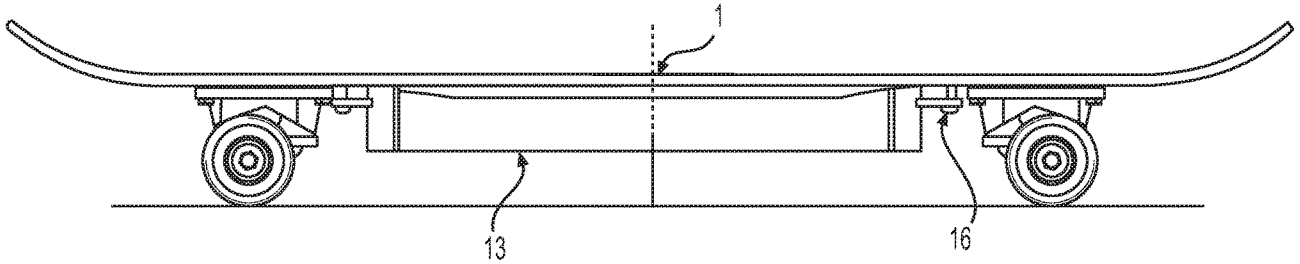
FIG. 13 is a side view of the compressive insert of FIG. 11, shown in the extended or released position.
Figure 14:
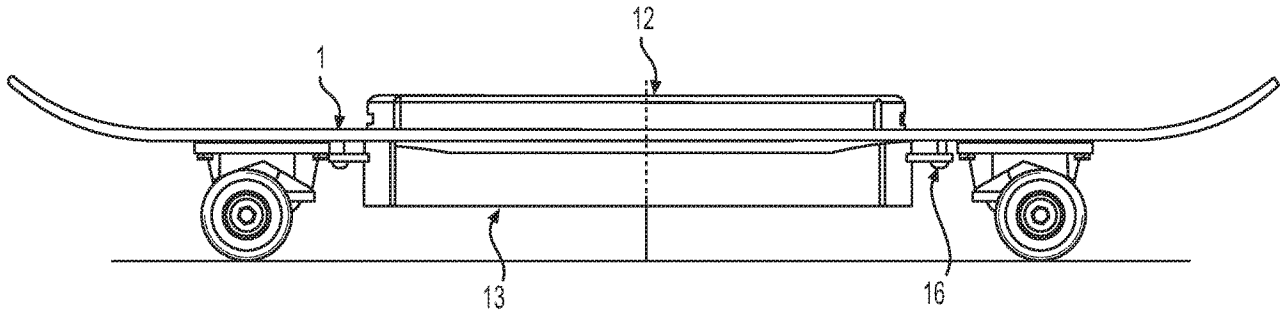
FIG. 14 is a side view of the compressive insert of FIG. 11, shown in the compressed position.

Referring to FIGS. 7-14, the insert 12 is arranged within a central portion of the compressive board. A compressive board wheel base 13 is slightly longer than the length of the insert. As shown in FIGS. 1 and 2, the insert periphery is surrounded by a reinforcing strip 14, such as a metal or another durable material to reinforce and improve traction between the insert and a cutout of the board for securing the insert. The insert is configured to assume a compressed position, as shown in FIGS. 8, 10 and 14, when a load is placed on the top surface of the board and to assume a released or extended position, as shown in FIGS. 7, 9 and 13, when the load is removed.

Configured with a plurality of compression members 15 and arranged to compress by moving downward towards the bottom of the board, the top surface of the insert becomes flush or substantially even with the top surface of the board once a load is placed thereon. The insert is configured to compress so that the insert is substantially flat along its entire length and width, or the entire area of the insert, when a load is applied to the top surface of the board. The insert's compression members, including but not limited to elastic members such as coil springs or spring-like elements, enable the insert to achieve both the compressed and released position.

By storing potential energy in the released or extended position, the compressive member enables the load or the user applying a load to the top surface of the board to remain in contact with the board's surface, even in an airborne and non-planar position. Furthermore, the user applying the load to the board's surface is able to maintain contact with the board and avoid slipping off of the board by gripping the raised insert between each of the user's feet. As such, the user is able to perform more complex maneuvers on the board due to the user's ability to compress a large portion of the board.

Referring to FIGS. 11-14, a non-limiting exemplary embodiment of the compressive board includes at least one locking mechanism 16 for securing the insert within the board. The locking mechanism assembly can be configured from materials including, but not limited to, one or more of rubber, metal, wood, plastic, and other known materials. Additionally, the type of the locking mechanism and its geometry may be selected from a ball and socket, an assembly using nuts and bolts, and any other locking mechanisms that are capable of being resiliently attached to at least one portion of the insert. As shown in FIGS. 12-14, a locking mechanism(s) may be secured to each end of the insert and the board's bottom surface. Further, as shown in FIG. 11, a portion of the locking mechanism(s) may be arranged within a portion of the insert, so as to increase the stability of the insert and move along with the insert's axial movement. The locking mechanism provides the advantage of ensuring that the insert does not compress below or extend above a certain threshold, thereby providing more consistent, stable and smooth movement on the compressive board's surface.

With the information contained herein, various departures from precise descriptions of the present subject matter will be readily apparent to those skilled in the art to which the present subject matter pertains, without departing from the spirit and the scope of the below claims. The present subject matter is not considered limited in scope to the procedures, properties, or components defined, since the preferred embodiments and other descriptions are intended only to be illustrative of particular aspects of the presently provided subject matter. Indeed, various modifications of the described modes for carrying out the present subject matter which are obvious to those skilled in compressive boards, board sports, or related fields are intended to be within the scope of the following claims.

The invention claimed is:

1. A compressive board apparatus comprising:

a generally planar surface having an upturned front end and an upturned rear end;

at least one front wheel fixed on a first axle and arranged near the front end;

at least one rear wheel fixed on a second axle and arranged near the rear end;

an insert arranged within a central portion of the compressive board, occupying a majority of the surface area of the board, wherein said insert is arranged to both extend above a top surface of the board and extend below a bottom surface of the compressive board, wherein a plurality of compression members are arranged within the insert, wherein said insert is arranged to be capable of compressing along an entire insert length and an entire insert width in response to a presence of a load applied by the user at any position the user desires along a top surface of the insert at any time during use of the board;

wherein said insert is arranged so that a user's feet may grip the insert by exerting a compressive motion along sides of the insert when the insert is uncompressed.

2. The board of claim 1, further comprising at least two front wheels.

3. The board of claim 1, further comprising at least two rear wheels.

4. The board of claim 1, wherein said compressible insert is arranged to compress and become flush with the top surface of the compressive board when a load is placed at any position along on a top surface of the compressible insert.

5. board of claim 1, wherein said compressible insert is arranged to return to a position extending above the top surface of the compressive board when the load is removed.

6. The board of claim 1, wherein said compressible insert is arranged to remain in contact with the load placed on the top surface of the compressible insert, even when the compressive board is oriented not parallel to a riding surface.

7. The board of claim 1, wherein said compressible insert is secured by at least one locking mechanism.

8. A compressive board apparatus comprising:

a generally planar deck;

at least one front wheel and at least one rear wheel;

an insert arranged within the compressive board, occupying a majority of the surface area of the board, wherein said insert is arranged to be capable of condensing to a compressed position and return to a non-compressed position in response to a respective presence or absence of a load applied by the user at any position the user desires along a top surface of the insert at any time during use of the board; and wherein said insert is arranged so that a user's feet may grip the insert by exerting a compressive motion along sides of the insert when the insert is uncompressed.

* * * * *